US012137737B2

(12) United States Patent
Batista et al.

(10) Patent No.: US 12,137,737 B2
(45) Date of Patent: Nov. 12, 2024

(54) RESILIENT SEALING ELEMENT FOR AEROSOL-GENERATING DEVICE

(71) Applicant: PHILIP MORRIS PRODUCTS S.A., Neuchatel (CH)

(72) Inventors: Rui Nuno Batista, Morges (CH); Ricardo Cali, Mannheim (DE)

(73) Assignee: Philip Morris Products S.A., Neuchatel (CH)

( * ) Notice: Subject to any disclaimer, the term of this patent is extended or adjusted under 35 U.S.C. 154(b) by 447 days.

(21) Appl. No.: 17/637,632

(22) PCT Filed: Aug. 25, 2020

(86) PCT No.: PCT/EP2020/073684
§ 371 (c)(1),
(2) Date: Feb. 23, 2022

(87) PCT Pub. No.: WO2021/037822
PCT Pub. Date: Mar. 4, 2021

(65) Prior Publication Data

US 2022/0273032 A1 Sep. 1, 2022

(30) Foreign Application Priority Data

Aug. 28, 2019 (EP) ..... 19194044

(51) Int. Cl.
*A24F 40/40* (2020.01)
*A24F 40/20* (2020.01)

(52) U.S. Cl.
CPC ..... *A24F 40/40* (2020.01); *A24F 40/20* (2020.01)

(58) Field of Classification Search
CPC ..... A24F 40/40; A24F 40/20; A24F 47/00; A61M 15/00
See application file for complete search history.

(56) References Cited

U.S. PATENT DOCUMENTS

2018/0098570 A1 4/2018 Hon
2019/0093783 A1 3/2019 Macko
2019/0150508 A1* 5/2019 Thorsen et al. ..... A24F 47/00

FOREIGN PATENT DOCUMENTS

CN 206443204 U 8/2017
CN 207574523 U 7/2018
CN 110169594 A 8/2019

OTHER PUBLICATIONS

Office Action issued in Japan for Application No. 2022-512319 dated Jan. 30, 2023 (5 pages). English translation included.
PCT International Search Report and Written Opinion for PCT/EP2020/073684 dated Oct. 15, 2020 (14 pages).
International Preliminary Report on Patentability for PCT/EP2020/073684 dated Dec. 2, 2021 (12 pages).

* cited by examiner

*Primary Examiner* — Christopher M Rodd
*Assistant Examiner* — Ronnie Kirby Jordan
(74) *Attorney, Agent, or Firm* — Mueting Raasch Group

(57) ABSTRACT

The invention relates to an aerosol-generating device comprising a cavity (10) for receiving an aerosol-generating article (12) containing aerosol-forming substrate (18). The device further comprises a resilient sealing element (38) having a ring shape. The resilient sealing element is arranged surrounding a downstream end of the cavity. The resilient sealing element is configured to interact with the aerosol-generating article received in the cavity by abutting the aerosol-generating article.

11 Claims, 5 Drawing Sheets

RESILIENT SEALING ELEMENT FOR AEROSOL-GENERATING DEVICE

This application is a U.S. National Stage Application of International Application No. PCT/EP2020/073684 filed Aug. 25, 2020, which was published in English on Mar. 4, 2021, as International Publication No. WO 2021/037822 A1. International Application No. PCT/EP2020/073684 claims priority to European Application No. 19194044.4 filed Aug. 28, 2019.

The present invention relates to an aerosol-generating device.

It is known to provide an aerosol-generating device for generating an inhalable vapor. Such devices may heat aerosol-forming substrate to a temperature at which one or more components of the aerosol-forming substrate are volatilised without burning the aerosol-forming substrate. An aerosol-forming substrate may be provided as part of an aerosol-generating article. The aerosol-generating article may have a rod shape for insertion of the aerosol-generating article into a cavity, such as a heating chamber, of the aerosol-generating device. A heating arrangement may be arranged around the heating chamber for heating the aerosol-forming substrate once the aerosol-generating article is inserted into the heating chamber of the aerosol-generating device. For optimizing heating efficiency and to hold the aerosol-generating article within the cavity, the cavity should have a diameter corresponding to the diameter of the aerosol-generating article. It may be difficult for a user to insert the aerosol-generating article into the cavity. During operation, the aerosol-generating article is heated by the heating arrangement. As a consequence, the dimensions of the aerosol-generating article may change. For example, the aerosol-generating article may shrink. Furthermore, the aerosol-forming substrate contained in the aerosol-forming article is depleted over time. This may further influence the shape of the aerosol-generating article. Particularly, with progressing depletion of the aerosol-forming substrate, the aerosol-forming substrate may shrink so that the overall diameter of the aerosol-generating article decreases. This may lead to an unwanted loosening of the aerosol-generating article received in the cavity.

It would be desirable to have an aerosol-generating device, in which insertion of an aerosol-generating article into a cavity of the aerosol-generating article is improved. It would be desirable to have an aerosol-generating device, in which loosening of an aerosol-generating article received in a cavity of the aerosol-generating device is prevented, particularly during use of the aerosol-generating device.

According to an embodiment of the invention, there is provided an aerosol-generating device comprising a cavity for receiving an aerosol-generating article containing aerosol-forming substrate. The device further comprises a resilient sealing element having a ring shape. The resilient sealing element is arranged surrounding a downstream end of the cavity. The resilient sealing element is configured to about the aerosol-generating article when the aerosol-generating article is received in the cavity. The resilient sealing element may comprise at least two resilient sealing elements, wherein the resilient sealing elements are flexible and ring-shaped, and wherein the at least two flexible ring-shaped resilient sealing elements are arranged axially parallel to the longitudinal axis of the aerosol-generating device and inverted.

The resilient sealing element aids insertion of the aerosol-generating article into the cavity. In this regard, during insertion of the aerosol-generating article, the aerosol-generating article may not be inserted perfectly centrally into the cavity or with a slight inclination with respect to the longitudinal axis of the cavity. The resilient sealing element, due to the resilient nature of the resilient sealing element, may compensate for one or both of an offset from a central insertion direction and an inclined insertion angle.

The term "ring shape" may refer to a portion of the resilient sealing element being the ring-shaped. Particularly, the term "ring shape" may refer to a downstream end face of the resilient sealing element being ring-shaped, more preferably having a circular cross-section.

The resilient sealing element may be flexible. The resilient sealing element may be elastic. The resilient sealing element may have a central aperture. The resilient sealing element may apply a pressure to the aerosol-generating article, when the aerosol-generating article is received in the cavity. The resilient sealing element may apply a pressure to the aerosol-generating article during insertion of the aerosol-generating article into the cavity. The resilient sealing element may directly abut the aerosol-generating article during and after insertion of the aerosol-generating article into the cavity. The resilient sealing element may fully surround the aerosol-generating article. The resilient sealing element may surround the outer circumference of the aerosol-generating article.

The central aperture of the resilient sealing element may have an inner diameter corresponding to or slightly smaller than the outer diameter of the aerosol-generating article. During insertion of the aerosol-generating article into the cavity, the aerosol-generating article may slightly push apart the inner surface of the central aperture of the resilient sealing element. The inner surface of the central aperture of the resilient sealing element may then snugly encompass the outer circumference of the aerosol-generating article.

The resilient sealing element may have a funnel shape. The central aperture of the resilient sealing element may have a funnel shape. The portion of the resilient sealing element upstream of the downstream end face of the resilient sealing element may be funnel shaped. The ring-shaped portion, particularly the ring-shaped downstream end face of the resilient sealing element may transfer to the funnel-shaped portion of the resilient sealing element. The funnel shape may aid insertion of the aerosol-generating article. A user may insert the aerosol-generating article with an offset with respect to the longitudinal axis of the cavity. In such a scenario, the upstream end face of the aerosol-generating article may contact the funnel of the resilient sealing element. The funnel may guide the upstream end face of the aerosol-generating article towards the central aperture of the resilient sealing element. The central aperture of the resilient sealing element may be arranged at the central longitudinal axis of the cavity. The resilient sealing element may be configured to center the aerosol-generating article during insertion of the aerosol-generating article into the cavity.

The resilient sealing element may fully surround the downstream end of the cavity. The resilient sealing element may have a ring shape. The resilient sealing element may have a flat shape. The resilient sealing element may have a flat shape except for the funnel shaped central aperture of the resilient sealing element. The center of the central aperture may lie on the central longitudinal axis of the cavity. The resilient sealing element may extend in a plane essentially perpendicular to the central longitudinal axis of the cavity. The central aperture of the resilient sealing element may have an inner diameter corresponding to or slightly smaller than the inner diameter of the cavity.

The resilient sealing element may be configured to enable insertion of the aerosol-generating article with an inclined insertion angle due to the flexible configuration of the resilient sealing element. The flexible nature of the resilient sealing element may lead to deformation of the resilient sealing element when the aerosol-generating article is inserted with an inclined insertion angle. The resilient sealing element may be configured to push the aerosol-generating article into a central orientation. The resilient sealing element may be configured to push the aerosol-generating article into an orientation along the longitudinal axis of the cavity.

The resilient sealing element may be configured to enable insertion of aerosol-generating articles with different diameters due to the flexible configuration of the resilient sealing element. During insertion of the aerosol-generating articles with different diameters, the central aperture of the resilient sealing element may expand according to the diameter of the aerosol-generating article. The resilient sealing element may be configured to expand. The resilient sealing element may be configured to expand radially. The resilient sealing element may be configured to expand radially outward. Particularly if the aerosol-generating articles have cylindrical shapes, the resilient sealing element may adapt to the different diameters of the aerosol-generating article is by expanding.

The resilient sealing element may be made of elastic heat resistant polymer or compound material, such as graphene, silicone, plastics or other suitable materials, and/or compounds of those.

The resilient sealing element may be configured to hermetically seal the cavity when the aerosol-generating article is received in the cavity except for allowing airflow through the aerosol-generating article. An outer circumference of the resilient sealing element may be attached to a housing of the aerosol-generating device. The attachment between the housing of the aerosol-generating device and the resilient sealing element may be a hermetically sealing attachment. The central aperture of the resilient sealing element may allow airflow through the central aperture. However, after insertion of an aerosol-generating article into the cavity, the central aperture will be filled out by the aerosol-generating article so that air may only exit the cavity through the aerosol-generating article.

The resilient sealing element may comprise at least two flexible ring-shaped resilient sealing elements. Each of the two flexible ring-shaped resilient sealing elements may be configured similar to the resilient sealing element described herein. Particularly, each of the two ring-shaped resilient sealing elements may have a funnel shape. The at least two flexible ring-shaped resilient sealing elements may be arranged axially parallel to the longitudinal axis of the aerosol-generating device. The central axes of the sealing elements may be arranged parallel to the longitudinal axis of the device. The central axes of the sealing elements may be arranged along the longitudinal axis of the device. In other words, the two flexible ring-shaped resilient sealing elements may be arranged next to each other parallel or along the longitudinal axis of the aerosol-generating device. The longitudinal axis of the aerosol-generating device may be identical to the longitudinal axis of the cavity. Providing two resilient sealing elements may increase the sealing action of the resilient sealing elements. Additionally, the centering action of the resilient sealing elements may be optimized by two resilient sealing elements contacting the aerosol-generating article during and after insertion of the aerosol-generating articles of the cavity.

The at least two flexible ring-shaped resilient sealing elements may be arranged coaxial, preferably axially overlapping. A compact arrangement of the two resilient sealing elements may be achieved in this way while still improving the guiding and centering of the aerosol-generating article during and after insertion of the aerosol-generating article into the cavity.

The at least two flexible ring-shaped resilient sealing elements may be arranged axially parallel to the longitudinal axis of the aerosol-generating device and inverted. The term "inverted" may refer to a mirrored or reversed or upside down arrangement of the resilient sealing elements. Particularly, the term "inverted" may refer to a mirrored or inverted arrangement of the resilient sealing elements with respect to a plane perpendicular to the longitudinal axis of the cavity. Specifically, one resilient sealing element may be funnel-shaped with the end face with the smaller diameter being oriented upstream, while the other sealing element may be funnel-shaped with the end face with the larger diameter being oriented upstream. The respective end faces of the resilient sealing elements may contact each other. The upstream end face of the downstream resilient sealing element may contact the downstream end face of the upstream resilient sealing element.

At a base of the cavity, at least one air aperture may be provided for enabling axial airflow into the cavity at the upstream end of the cavity. The air aperture may have a longitudinal extension in the axial direction of the aerosol generating device. The air aperture may have a circular cross-section. The air aperture may have an elongate, elliptical or rectangular cross-section.

The airflow into the cavity may be enabled in axial direction, while airflow into the cavity in a lateral direction may be prevented by a thermally insulating element. For attaching the thermally insulating element to the base of the cavity, the thermally insulating element may be glued to the base of the cavity. The upstream end face of the thermally insulating element may be glued to the base of the cavity. Alternatively, the thermally insulating element may extend over the base of the cavity such that an inner side face of the thermally insulating elements may be attached to the base of the cavity such as by gluing.

The thermally insulating element may partly or fully form a sidewall of the cavity. The thermally insulating element may partly or fully extend along the axial length of the cavity. The thermally insulating element may directly abut the base of the cavity. The thermally insulating element may be directly attached to the base of the cavity, thereby facilitating the sealing attachment between the thermally insulating element and the base.

The aerosol-generating device may further comprise an induction heating arrangement. The induction heating arrangement may be configured to generate heat by means of induction. The induction heating arrangement may comprise an induction coil and a susceptor arrangement. A single induction coil may be provided. A single susceptor arrangement may be provided. Preferably, more than a single induction coil is provided. A first induction coil and a second induction coil may be provided. Preferably, more than a single susceptor arrangement is provided. Preferably, a first susceptor arrangement and a second susceptor arrangement are provided. The induction coil may surround the susceptor arrangement. The first induction coil may surround the first susceptor arrangement. The second induction coil may surround the second susceptor arrangement. Alternatively, at least two induction coils may be provided surrounding a single susceptor arrangement. If more than one susceptor arrangements are provided, preferably electrically insulating elements are provided between the susceptor arrangements.

The compartment, in which the induction coil may be arranged, may be hermetically sealed from the cavity by the thermally insulating element at the downstream end of the cavity. The compartment, in which the induction coil may be arranged, may be arranged surrounding the cavity. This compartment may be referred to as coil compartment. The coil compartment may partly or fully surround the cavity. The coil compartment may extend along the full length of the cavity. The coil compartment may house the induction coil or multiple induction coils.

The aerosol-generating device may comprise a downstream air inlet connected with the coil compartment. Alternatively, the aerosol-generating device may comprise an air inlet adjacent an upstream end of the cavity. The air inlet may be fluidly connected with the air aperture in the base of the cavity.

The aerosol-generating device may comprise a power supply. The power supply may be a direct current (DC) power supply. The power supply may be electrically connected to the first induction coil. In one embodiment, the power supply is a DC power supply having a DC supply voltage in the range of about 2.5 Volts to about 4.5 Volts and a DC supply current in the range of about 1 Amp to about 10 Amps (corresponding to a DC power supply in the range of about 2.5 Watts to about 45 Watts). The aerosol-generating device may advantageously comprise a direct current to alternating current (DC/AC) inverter for converting a DC current supplied by the DC power supply to an alternating current. The DC/AC converter may comprise a Class-D or Class-E power amplifier. The power supply may be configured to provide the alternating current.

The power supply may be a battery, such as a rechargeable lithium ion battery. Alternatively, the power supply may be another form of charge storage device such as a capacitor. The power supply may require recharging. The power supply may have a capacity that allows for the storage of enough energy for one or more uses of the aerosol-generating device. For example, the power supply may have sufficient capacity to allow for the continuous generation of aerosol for a period of around six minutes, corresponding to the typical time taken to smoke a conventional cigarette, or for a period that is a multiple of six minutes. In another example, the power supply may have sufficient capacity to allow for a predetermined number of puffs or discrete activations.

The power supply may be configured to operate at high frequency. As used herein, the term "high frequency oscillating current" means an oscillating current having a frequency of between 500 kilohertz and 30 megahertz. The high frequency oscillating current may have a frequency of from about 1 megahertz to about 30 megahertz, preferably from about 1 megahertz to about 10 megahertz and more preferably from about 5 megahertz to about 8 megahertz.

The susceptor arrangement may comprise a susceptor. The susceptor arrangement may comprise multiple susceptors. The susceptor arrangement may comprise blade shaped susceptors. The blade shaped susceptors may be arranged surrounding the cavity. The blade shaped susceptors may be arranged inside of the cavity. The blade shaped susceptors may be arranged for holding the aerosol-generating article, when the aerosol-generating article is inserted into the cavity. The blade shaped susceptors may have flared downstream ends to facilitate insertion of the aerosol-generating article into the blade shaped susceptors. Air may flow into the cavity through the air aperture in the base of the cavity. The air may subsequently enter into the aerosol-generating article at the upstream end face of the aerosol-generating article. Alternatively or additionally, air may flow between the sidewall of the cavity, preferably formed by the thermally insulating element, and the blade shaped susceptors. The air may then enter into the aerosol-generating article through gaps between the blade shaped susceptors. A uniform penetration of the aerosol-generating article with air may be achieved in this way, thereby optimizing aerosol generation.

The aerosol-generating device may comprise a flux concentrator. The flux concentrator may be made from a material having a high magnetic permeability. The flux concentrator may be arranged surrounding the induction heating arrangement. The flux concentrator may concentrate the magnetic field lines to the interior of the flux concentrator thereby increasing the heating effect of the susceptor arrangement by means of the induction coil.

The aerosol-generating device may comprise a controller. The controller may be electrically connected to the induction coil. The controller may be electrically connected to the first induction coil and to the second induction coil. The controller may be configured to control the electrical current supplied to the induction coils, and thus the magnetic field strength generated by the induction coils.

The power supply and the controller may be connected to the induction coil, preferably the first and second induction coils and configured to provide the alternating electric current to each of the induction coils independently of each other such that, in use, the induction coils each generate the alternating magnetic field. This means that the power supply and the controller may be able to provide the alternating electric current to the first induction coil on its own, to the second induction coil on its own, or to both induction coils simultaneously. Different heating profiles may be achieved in that way. The heating profile may refer to the temperature of the respective induction coil. To heat to a high temperature, alternating electric current may be supplied to both induction coils at the same time. To heat to a lower temperature or to heat only a portion of the aerosol-forming substrate of the aerosol-generating article, alternating electric current may be supplied to the first induction coil only. Subsequently, alternating electric current may be supplied to the second induction coil only.

The controller may be connected to the induction coils and the power supply. The controller may be configured to control the supply of power to the induction coils from the power supply. The controller may comprise a microprocessor, which may be a programmable microprocessor, a microcontroller, or an application specific integrated chip (ASIC) or other electronic circuitry capable of providing control. The controller may comprise further electronic components. The controller may be configured to regulate a supply of current to the induction coils. Current may be supplied to one or both of the induction coils continuously following activation of the aerosol-generating device or may be supplied intermittently, such as on a puff by puff basis.

The power supply and the controller may be configured to vary independently the amplitude of the alternating electric current supplied to each of the first induction coil and the second induction coil. With this arrangement, the strength of the magnetic fields generated by the first and second induction coils may be varied independently by varying the amplitude of the current supplied to each coil. This may facilitate a conveniently variable heating effect. For example, the amplitude of the current provided to one or both of the coils may be increased during start-up to reduce the initiation time of the aerosol-generating device.

The first induction coil of the aerosol-generating device may form part of a first circuit. The first circuit may be a resonant circuit. The first circuit may have a first resonant frequency. The first circuit may comprise a first capacitor. The second induction coil may form part of a second circuit. The second circuit may be a resonant circuit. The second circuit may have a second resonant frequency. The first resonance frequency may be different from the second resonance frequency. The first resonance frequency may be identical to the second resonance frequency. The second circuit may comprise a second capacitor. The resonant frequency of the resonant circuit depends on the inductance of the respective induction coil and the capacitance of the respective capacitor.

The cavity of the aerosol-generating device may have an open end into which an aerosol-generating article is inserted. The cavity may have a closed end opposite the open end. The closed end may be the base of the cavity. The closed end may be closed except for the provision of the air apertures arranged in the base. The base of the cavity may be flat. The base of the cavity may be circular. The base of the cavity may be arranged upstream of the cavity. The open end may be arranged downstream of the cavity. The longitudinal direction may be the direction extending between the open and closed ends. The longitudinal axis of the cavity may be parallel with the longitudinal axis of the aerosol-generating device.

The cavity may be configured as a heating chamber. The cavity may have a cylindrical shape. The cavity may have a hollow cylindrical shape. The cavity may have a circular cross-section. The cavity may have an elliptical or rectangular cross-section. The cavity may have a diameter corresponding to the diameter of the aerosol-generating article. As used herein, the term "proximal" refers to a user end, or mouth end of the aerosol-generating device, and the term "distal" refers to the end opposite to the proximal end. When referring to the cavity, the term "proximal" refers to the region closest to the open end of the cavity and the term "distal" refers to the region closest to the closed end.

As used herein, the term "length" refers to the major dimension in a longitudinal direction of the aerosol-generating device, of an aerosol-generating article, or of a component of the aerosol-generating device or an aerosol-generating article.

As used herein, the term "width" refers to the major dimension in a transverse direction of the aerosol-generating device, of an aerosol-generating article, or of a component of the aerosol-generating device or an aerosol-generating article, at a particular location along its length. The term "thickness" refers to the dimension in a transverse direction perpendicular to the width.

As used herein, the term "aerosol-forming substrate" relates to a substrate capable of releasing volatile compounds that can form an aerosol. Such volatile compounds may be released by heating the aerosol-forming substrate. An aerosol-forming substrate is part of an aerosol-generating article.

As used herein, the term "aerosol-generating article" refers to an article comprising an aerosol-forming substrate that is capable of releasing volatile compounds that can form an aerosol. For example, an aerosol-generating article may be an article that generates an aerosol that is directly inhalable by the user drawing or puffing on a mouthpiece at a proximal or user-end of the system. An aerosol-generating article may be disposable. An article comprising an aerosol-forming substrate comprising tobacco is referred to as a tobacco stick. The aerosol-generating article may be insertable into the cavity of the aerosol-generating device.

As used herein, the term "aerosol-generating device" refers to a device that interacts with an aerosol-generating article to generate an aerosol.

As used herein, the term "aerosol-generating system" refers to the combination of an aerosol-generating article, as further described and illustrated herein, with an aerosol-generating device, as further described and illustrated herein. In the system, the aerosol-generating article and the aerosol-generating device cooperate to generate a respirable aerosol. The invention may also relate to an aerosol-generating system.

As used herein, a "susceptor arrangement" means a conductive element that heats up when subjected to a changing magnetic field. This may be the result of eddy currents induced in the susceptor arrangement, hysteresis losses, or both eddy currents and hysteresis losses. During use, the susceptor arrangement is located in thermal contact or close thermal proximity with the aerosol-forming substrate of an aerosol-generating article received in the cavity of the aerosol-generating device. In this manner, the aerosol-forming substrate is heated by the susceptor arrangement such that an aerosol is formed.

The susceptor arrangement may have a cylindrical shape, preferably constituted by individual blade shaped susceptors. The susceptor arrangement may have a shape corresponding to the shape of the corresponding induction coil. The susceptor arrangement may have a diameter smaller than the diameter of the corresponding induction coil such that the susceptor arrangement can be arranged inside of the induction coil.

The term "heating zone" refers to a portion of the length of the cavity which is at least partially surrounded by the induction coils so that the susceptor arrangement placed in or around the heating zone is inductively heatable by the induction coils. The heating zone may comprise a first heating zone and a second heating zone. The heating zone may be split into the first heating zone and the second heating zone. The first heating zone may be surrounded by the first induction coil. The second heating zone may be surrounded by the second induction coil. More than two heating zones may be provided. Multiple heating zones may be provided. An induction coil may be provided for each heating zone. One or more induction coils may be arranged moveable to surround the heating zones and configured for segmented heating of the heating zones.

The term "coil" as used herein is interchangeable with the terms "inductive coil" or "induction coil" or "inductor" or "inductor coil" throughout. A coil may be a driven (primary) coil connected to the power supply.

The heating effect may be varied by controlling the first and second induction coils independently. The heating effect may be varied by providing the first and second induction coils with different configurations so that the magnetic field generated by each coil under the same applied current is different. For example, the heating effect may be varied by forming the first and second induction coils from different types of wire so that the magnetic field generated by each coil under the same applied current is different. The heating effect may be varied by controlling the first and second induction coils independently and by providing the first and second induction coils with different configurations so that the magnetic field generated by each coil under the same applied current is different.

The induction coil(s) are each disposed at least partially around the heating zone. The induction coil may extend only partially around the circumference of the cavity in the region of the heating zone. The induction coil may extend around the entire circumference of the cavity in the region of the heating zone.

The induction coil(s) may be a planar coil disposed around part of the circumference of the cavity or fully around the circumference of the cavity. As used herein a "planar coil" means a spirally wound coil having an axis of winding which is normal to the surface in which the coil lies. The planar coil may lie in a flat Euclidean plane. The planar coil may lie on a curved plane. For example, the planar coil may be wound in a flat Euclidian plane and subsequently bent to lie on a curved plane.

Advantageously, the induction coil(s) is helical. The induction coil may be helical and wound around a central void in which the cavity is positioned. The induction coil may be disposed around the entire circumference of the cavity.

The induction coil(s) may be helical and concentric. The first and second induction coils may have different diameters. The first and second induction coils may be helical and concentric and may have different diameters. In such embodiments, the smaller of the two coils may be positioned at least partially within the larger of the first and second induction coils.

The windings of the first induction coil may be electrically insulated from the windings of the second induction coil.

The aerosol-generating device may further comprise one or more additional induction coils. For example, the aerosol-generating device may further comprise third and fourth induction coils, preferably associated with additional susceptors, preferably associated with different heating zones.

Advantageously, the first and second induction coils have different inductance values. The first induction coil may have a first inductance and the second induction coil may have a second inductance which is less than the first inductance. This means that the magnetic fields generated by the first and second induction coils will have different strengths for a given current. This may facilitate a different heating effect by the first and second induction coils while applying the same amplitude of current to both coils. This may reduce the control requirements of the aerosol-generating device. Where the first and second induction coils are activated independently, the induction coil with the greater inductance may be activated at a different time to the induction coil with the lower inductance. For example, the induction coil with the greater inductance may be activated during operation, such as during puffing, and the induction coil with the lower inductance may be activated between operations, such as between puffs. Advantageously, this may facilitate the maintenance of an elevated temperature within the cavity between uses without requiring the same power as normal use. This 'pre-heat' may reduce the time taken for the cavity to return to the desired operating temperature once operation of the aerosol-generating device use is resumed. Alternatively, the first induction coil and the second induction coil may have the same inductance values.

The first and second induction coils may be formed from the same type of wire. Advantageously, the first induction coil is formed from a first type of wire and the second induction coil is formed from a second type of wire which is different to the first type of wire. For example, the wire compositions or cross-sections may differ. In this manner, the inductance of the first and second induction coils may be different even if the overall coil geometries are the same. This may allow the same or similar coil geometries to be used for the first and second induction coils. This may facilitate a more compact arrangement.

The first type of wire may comprise a first wire material and the second type of wire may comprise a second wire material which is different from the first wire material. The electrical properties of the first and second wire materials may differ. For example, first type of wire may have a first resistivity and the second type of wire may have a second resistivity which is different to the first resistivity.

Suitable materials for the induction coil(s) include copper, aluminium, silver and steel. Preferably, the induction coil is formed from copper or aluminium.

Where the first induction coil is formed from a first type of wire and the second induction coil is formed from a second type of wire which is different to the first type of wire, the first type of wire may have a different cross-section to the second type of wire. The first type of wire may have a first cross-section and the second type of wire may have a second cross-section which is different to the first cross-section. For example, the first type of wire may have a first cross-sectional shape and the second type of wire may have a second cross-sectional shape which is different to the first cross-sectional shape. The first type of wire may have a first thickness and the second type of wire may have a second thickness which is different to the first thickness. The cross-sectional shape and the thickness of the first and second types of wire may be different.

The susceptor arrangement may be formed from any material that can be inductively heated to a temperature sufficient to aerosolise an aerosol-forming substrate. Suitable materials for the susceptor arrangement include graphite, molybdenum, silicon carbide, stainless steels, niobium, aluminium, nickel, nickel containing compounds, titanium, and composites of metallic materials. Preferred susceptor arrangements comprise a metal or carbon. Advantageously the susceptor arrangement may comprise or consists of a ferromagnetic material, for example, ferritic iron, a ferromagnetic alloy, such as ferromagnetic steel or stainless steel, ferromagnetic particles, and ferrite. A suitable susceptor arrangement may be, or comprise, aluminium. The susceptor arrangement may comprise more than 5 percent, preferably more than 20 percent, more preferably more than 50 percent or more than 90 percent of ferromagnetic or paramagnetic materials. Preferred susceptor arrangements may be heated to a temperature in excess of 250 degrees Celsius.

The susceptor arrangement may be formed from a single material layer. The single material layer may be a steel layer.

The susceptor arrangement may comprise a non-metallic core with a metal layer disposed on the non-metallic core. For example, the susceptor arrangement may comprise metallic tracks formed on an outer surface of a ceramic core or substrate.

The susceptor arrangement may be formed from a layer of austenitic steel. One or more layers of stainless steel may be arranged on the layer of austenitic steel. For example, the susceptor arrangement may be formed from a layer of austenitic steel having a layer of stainless steel on each of its upper and lower surfaces. The susceptor arrangement may comprise a single susceptor material. The susceptor arrangement may comprise a first susceptor material and a second susceptor material. The first susceptor material may be disposed in intimate physical contact with the second susceptor material. The first and second susceptor materials may be in intimate contact to form a unitary susceptor. In certain embodiments, the first susceptor material is stainless steel and the second susceptor material is nickel. The susceptor arrangement may have a two layer construction. The susceptor arrangements may be formed from a stainless steel layer and a nickel layer.

Intimate contact between the first susceptor material and the second susceptor material may be made by any suitable means. For example, the second susceptor material may be plated, deposited, coated, clad or welded onto the first susceptor material. Preferred methods include electroplating, galvanic plating and cladding.

The second susceptor material may have a Curie temperature that is lower than 500 degrees Celsius. The first susceptor material may be primarily used to heat the susceptor when the susceptor is placed in an alternating electromagnetic field. Any suitable material may be used. For example, the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate. Suitable materials for the second susceptor material may include nickel and certain nickel alloys. The Curie temperature of the second susceptor material may preferably be selected to be lower than 400 degrees Celsius, preferably lower than 380 degrees Celsius, or lower than 360 degrees Celsius. It is preferable that the second susceptor material is a magnetic material selected to have a Curie temperature that is substantially the same as a desired maximum heating temperature. That is, it is preferable that the Curie temperature of the second susceptor material is approximately the same as the temperature that the susceptor should be heated to in order to generate an aerosol from the aerosol-forming substrate. The Curie temperature of the second susceptor material may, for example, be within the range of 200 degrees Celsius to 400 degrees Celsius, or between 250 degrees Celsius and 360 degrees Celsius. In some embodiments it may be preferred that the first susceptor material and the second susceptor material are co-laminated. The co-lamination may be formed by any suitable means. For example, a strip of the first susceptor material may be welded or diffusion bonded to a strip of the second susceptor material. Alternatively, a layer of the second susceptor material may be deposited or plated onto a strip of the first susceptor material.

Preferably, the aerosol-generating device is portable. The aerosol-generating device may have a size comparable to a conventional cigar or cigarette. The system may be an electrically operated smoking system. The system may be a handheld aerosol-generating system. The aerosol-generating device may have a total length between approximately 30 millimetres and approximately 150 millimetres. The aerosol-generating device may have an external diameter between approximately 5 millimetres and approximately 30 millimetres.

The housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

Alternatively, the mouthpiece may be provided as part of an aerosol-generating article.

As used herein, the term "mouthpiece" refers to a portion of an aerosol-generating device that is placed into a user's mouth in order to directly inhale an aerosol generated by the aerosol-generating device from an aerosol-generating article received in the cavity of the housing.

The air inlet may be configured as a semi-open inlet. The semi-open inlet preferably allows air to enter the aerosol-generating device. Air or liquid may be prevented from leaving the aerosol-generating device through the semi-open inlet. The semi-open inlet may for example be a semi-permeable membrane, permeable in one direction only for air, but is air- and liquid-tight in the opposite direction. The semi-open inlet may for example also be a one-way valve. Preferably, the semi-open inlets allow air to pass through the inlet only if specific conditions are met, for example a minimum depression in the aerosol-generating device or a volume of air passing through the valve or membrane.

Operation of the heating arrangement may be triggered by a puff detection system. Alternatively, the heating arrangement may be triggered by pressing an on-off button, held for the duration of the user's puff. The puff detection system may be provided as a sensor, which may be configured as an airflow sensor to measure the airflow rate. The airflow rate is a parameter characterizing the amount of air that is drawn through the airflow path of the aerosol-generating device per time by the user. The initiation of the puff may be detected by the airflow sensor when the airflow exceeds a predetermined threshold. Initiation may also be detected upon a user activating a button.

The sensor may also be configured as a pressure sensor to measure the pressure of the air inside the aerosol-generating device which is drawn through the airflow path of the device by the user during a puff. The sensor may be configured to measure a pressure difference or pressure drop between the pressure of ambient air outside of the aerosol-generating device and of the air which is drawn through the device by the user. The pressure of the air may be detected at the air inlet, the mouthpiece of the device, the cavity such as the heating chamber or any other passage or chamber within the aerosol-generating device, through which the air flows. When the user draws on the aerosol-generating device, a negative pressure or vacuum is generated inside the device, wherein the negative pressure may be detected by the pressure sensor. The term "negative pressure" is to be understood as a pressure which is relatively lower than the pressure of ambient air. In other words, when the user draws on the device, the air which is drawn through the device has a pressure which is lower than the pressure off ambient air outside of the device. The initiation of the puff may be detected by the pressure sensor if the pressure difference exceeds a predetermined threshold.

The aerosol-generating device may include a user interface to activate the aerosol-generating device, for example a button to initiate heating of the aerosol-generating device or display to indicate a state of the aerosol-generating device or of the aerosol-forming substrate.

The aerosol-generating system is a combination of an aerosol-generating device and one or more aerosol-generating articles for use with the aerosol-generating device. However, the aerosol-generating system may include additional components, such as, for example a charging unit for recharging an on-board electric power supply in an electrically operated or electric aerosol-generating device.

The aerosol-forming substrate may comprise nicotine. The nicotine-containing aerosol-forming substrate may be a nicotine salt matrix. The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. Alternatively, the aerosol-forming substrate may comprise a non-tobacco material. The aerosol-forming substrate may comprise homogenised plant-based material. The aerosol-forming substrate may comprise homogenised tobacco material. Homogenised tobacco material may be formed by agglomerating particulate tobacco. In a particularly preferred embodiment, the aerosol-forming substrate may comprise a gathered crimped sheet of homogenised tobacco material. As used herein, the term 'crimped sheet' denotes a sheet having a plurality of substantially parallel ridges or corrugations.

The aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol. Preferably, the aerosol former is glycerine. Where present, the homogenised tobacco material may have an aerosol-former content of equal to or greater than 5 percent by weight on a dry weight basis, and preferably from about 5 percent to about 30 percent by weight on a dry weight basis. The aerosol-forming substrate may comprise other additives and ingredients, such as flavourants.

In any of the above embodiments, the aerosol-generating article and the cavity of the aerosol-generating device may be arranged such that the aerosol-generating article is partially received within the cavity of the aerosol-generating device. The cavity of the aerosol-generating device and the aerosol-generating article may be arranged such that the aerosol-generating article is entirely received within the cavity of the aerosol-generating device.

The aerosol-generating article may be substantially cylindrical in shape. The aerosol-generating article may be substantially elongate. The aerosol-generating article may have a length and a circumference substantially perpendicular to the length. The aerosol-forming substrate may be provided as an aerosol-forming segment containing an aerosol-forming substrate. The aerosol-forming segment may be substantially cylindrical in shape. The aerosol-forming segment may be substantially elongate. The aerosol-forming segment may also have a length and a circumference substantially perpendicular to the length.

The aerosol-generating article may have a total length between approximately 30 millimetres and approximately 100 millimetres. In one embodiment, the aerosol-generating article has a total length of approximately 45 millimetres. The aerosol-generating article may have an external diameter between approximately 5 millimetres and approximately 12 millimetres. In one embodiment, the aerosol-generating article may have an external diameter of approximately 7.2 millimetres.

The aerosol-forming substrate may be provided as an aerosol-forming segment having a length of between about 7 millimetres and about 15 millimetres. In one embodiment, the aerosol-forming segment may have a length of approximately 10 millimetres. Alternatively, the aerosol-forming segment may have a length of approximately 12 millimetres.

The aerosol-generating segment preferably has an external diameter that is approximately equal to the external diameter of the aerosol-generating article. The external diameter of the aerosol-forming segment may be between approximately 5 millimetres and approximately 12 millimetres. In one embodiment, the aerosol-forming segment may have an external diameter of approximately 7.2 millimetres.

The aerosol-generating article may comprise a filter plug. The filter plug may be located at a downstream end of the aerosol-generating article. The filter plug may be a cellulose acetate filter plug. The filter plug may be a hollow cellulose acetate filter plug. The filter plug is approximately 7 millimetres in length in one embodiment, but may have a length of between approximately 5 millimetres to approximately 10 millimetres.

As used herein, the terms 'upstream' and 'downstream' are used to describe the relative positions of components, or portions of components, of the aerosol-generating device in relation to the direction in which a user draws on the aerosol-generating device during use thereof.

The aerosol-generating article may comprise an outer paper wrapper. Further, the aerosol-generating article may comprise a separation between the aerosol-forming substrate and the filter plug. The separation may be approximately 18 millimetres, but may be in the range of approximately 5 millimetres to approximately 25 millimetres.

Features described in relation to one embodiment may equally be applied to other embodiments of the invention.

The invention will be further described, by way of example only, with reference to the accompanying drawings in which.

Figure 1:
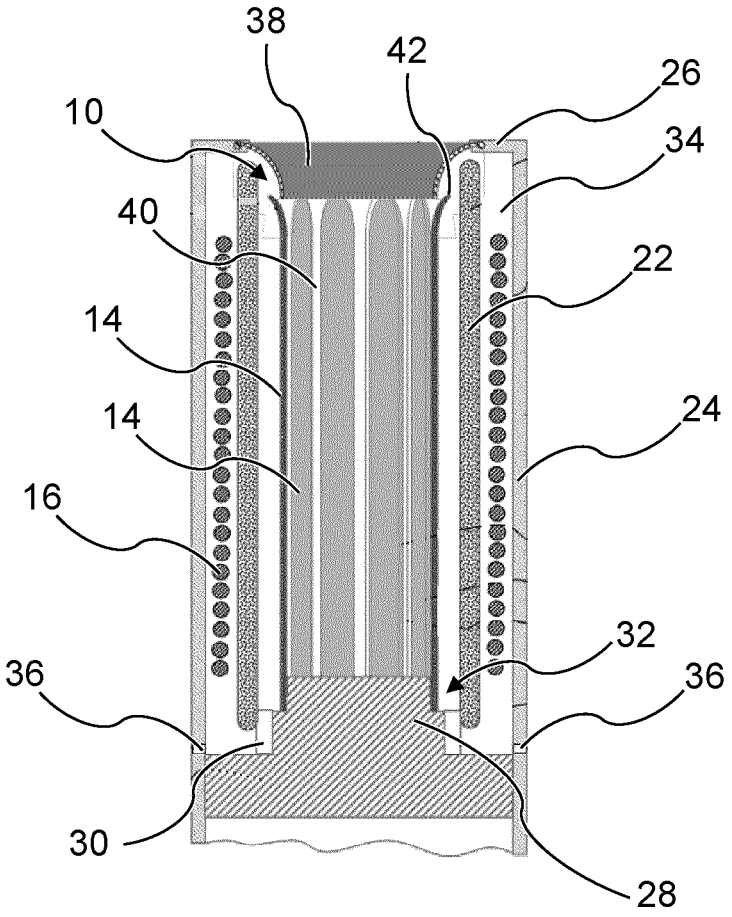
FIG. 1 shows a cross-sectional view of an aerosol-generating device according to the present invention.

FIG. 1 shows a proximal or downstream portion of an aerosol-generating device. The aerosol-generating device comprises a cavity 10 for insertion of an aerosol-generating article 12. The inserted aerosol-generating article 12 can be seen in FIG. 2. The cavity 10 is configured as a heating chamber.

Inside of the cavity 10, a susceptor arrangement 14 is arranged. The susceptor arrangement 14 comprises multiple susceptor blades. The individual susceptor blades are flared at respective downstream ends 42 to ease insertion of the aerosol-generating article 12 into the cavity 10. The inner diameter of the susceptor arrangement 14 corresponds or may be slightly smaller than the outer diameter of the aerosol-generating article 12. The aerosol-generating article 12 is held by the susceptor arrangement 14 after insertion of the aerosol-generating article 12 into the cavity 10.

The susceptor arrangement 14 is part of an induction heating arrangement. The induction heating arrangement comprises an induction coil 16. The induction coil 16 is arranged at least partly surrounding the cavity 10. The induction coil 16 surrounds the full circumference of the cavity 10. The induction coil 16 is arranged surrounding the susceptor arrangement 14. The induction coil 16 surrounds the part of the cavity 10, in which a substrate portion 18 of the aerosol-generating article 12 is received. A filter portion 20 of the aerosol-generating article 12 sticks out of the cavity 10 after insertion of the aerosol-generating article 12 into the cavity 10. A user draws on the filter portion 20.

Between the individual susceptors of the susceptor arrangement 14, gaps 40 are provided. The gaps 40 enable airflow into the aerosol-generating article 12 after insertion of the aerosol-generating article 12 into the cavity 10. The gaps 40 preferably enable a radial airflow from the space of the cavity 10 between a thermally insulating element 22 and the susceptor arrangement 14 into the aerosol-generating article 12. Consequently, the gaps 40 enable an inward radial airflow. The gaps 40 have an elongate shape. The gaps 40 may extend along essentially the length of the substrate portion 18 of the aerosol-generating article 12.

More than one induction coil 16 may be provided. Preferably, two induction coils 16 or more than two induction coils 16 are provided. The induction coils 16 may be part of the induction heating arrangement. The induction coils 16 may be separately controllable to enable heating of separate heating zones within the cavity 10. Exemplarily, a first induction coil may be arranged surrounding a downstream portion of the cavity 10 corresponding to a downstream heating zone, while a second induction coil may be arranged surrounding an upstream portion of the cavity 10 corresponding to an upstream heating zone.

The aerosol-generating device may comprise further elements not shown in the figures such as a controller for controlling the induction heating arrangement. The controller may be configured to separately control individual coils, if the induction heating arrangement comprises more than one induction coil 16. The aerosol-generating device may comprise a power supply such as a battery. The controller may be configured to control the supply of electrical energy from the power supply to the induction coil 16 or to the individual induction coils 16.

Between the susceptor arrangement 14 and the induction coil 16, the thermally insulating element 22 is arranged. The thermally insulating element 22 forms the sidewall of the cavity 10. The thermally insulating element 22 has an elongate extension. The thermally insulating element 22 has a hollow cylindrical shape. The thermally insulating element 22 is attached to a housing 24 of the aerosol-generating device. Preferably, the thermally insulating element 22 is attached to a downstream end 26 of the housing 24 as depicted in FIG. 1. Additionally, the thermally insulating element 22 is attached to a base 28 of the cavity 10 at a downstream end of the cavity 10. In the base 28 of the cavity 10, one or more air apertures 30 are arranged.

The air aperture 30 has an elongate extension parallel to the longitudinal axis of the aerosol-generating device. The air aperture 30 allows air to enter into the cavity 10 at an upstream end 32 of the cavity 10. The thermally insulating element 22 prevents air from entering into the cavity 10 in a lateral direction.

The induction coil 16 is arranged in a coil compartment 34. The coil compartment 34 is arranged surrounding the thermally insulating element 22. A layered structure is provided with the cavity 10 centrally in the middle. Surrounding the cavity 10, the thermally insulating element 22 is provided. Surrounding the thermally insulating element 22, the coil compartment 34 is arranged. Surrounding the coil compartment 34, the housing 24 of the aerosol-generating device is provided.

An air inlet 36 is provided to enable ambient air to enter the coil compartment 34. The air inlet 36 is arranged at the downstream end 26 of the housing 24. The air inlet 36 is arranged adjacent the coil compartment 34. The air inlet 36 is provided between the outer circumference of the housing 24 and the part of the downstream end 26 of the housing 24 connected to the thermally insulating element 22. Alternatively, as shown in FIG. 1, the air inlet 36 is placed in the sidewall of the housing 24 of the aerosol-generating device. In other words, the air inlet 36 is placed in the outer circumference of the housing 24 of the aerosol-generating device. The air inlet 36 is arranged adjacent the upstream end of the cavity 10.

In FIG. 1, a resilient sealing element 38 is shown at the downstream end of the cavity 10. The resilient sealing element 38 is arranged surrounding the downstream end of the cavity 10. The resilient sealing element 38 has a circular or ring shape. The resilient sealing element 38 has a funnel shape facilitating insertion of the aerosol-generating article 12. The resilient sealing element 38 applies pressure to the aerosol-generating article 12 after insertion of the aerosol-generating article 12 to hold the aerosol-generating article 12 in place. The resident sealing element 38 abuts the aerosol-generating article 12 during and after insertion of the aerosol-generating article into the cavity 10. The resilient sealing element 38 is air impenetrable to prevent air from escaping the cavity 10 except for escaping through the aerosol-generating article 12. The resident sealing element 38 is flexible. The resilient sealing element 38 is attached to the downstream end 26 of the housing 24. The resilient sealing element 38 fully surrounds the downstream end of the cavity 10.

Figure 2:
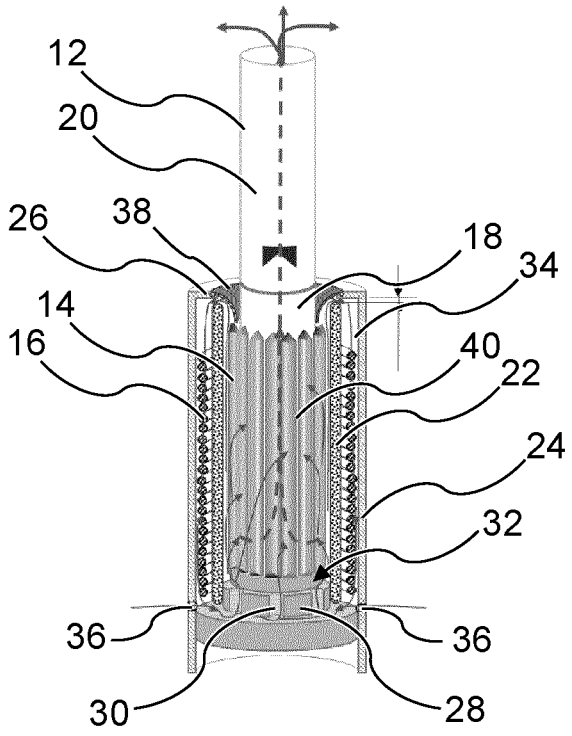
FIG. 2 shows an illustrative view of the aerosol-generating device with an inserted aerosol-generating article.

FIG. 2 shows an illustration of the aerosol-generating device, in which an aerosol-generating article 12 is inserted into the cavity 10. The substrate portion 18 of the aerosol-generating article 12 is received in the cavity 10. A filter portion 20 of the aerosol-generating article 12 sticks out of the cavity 10 for a user to draw on the aerosol-generating article 12. The resilient element 38 directly abuts the outer circumference of the aerosol-generating article 12 so that air can only exit the cavity 10 through the aerosol-generating article 12.

In addition to the inserted aerosol-generating article 12, the airflow is indicated in FIG. 2. Air flows into the aerosol-generating device through the air inlet 36. More than one air inlet 36 may be provided. The air flows through the coil compartment 34. After exiting the coil compartment 34, the air flows into the cavity 10 through the air aperture 30 arranged at the base 28 of the cavity 10. The air subsequently flows into the aerosol-generating article 12 through gaps provided between the individual susceptor blades.

Figure 3:
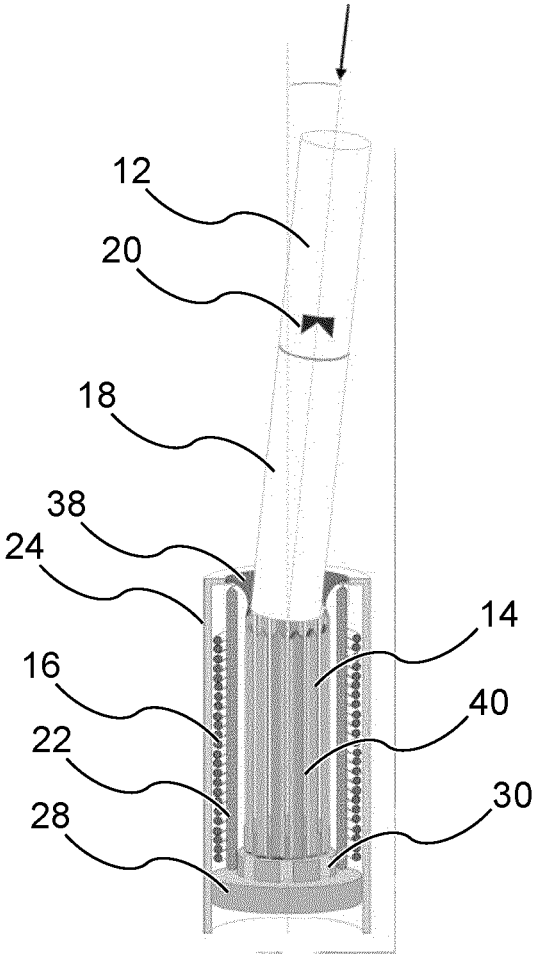
FIG. 3 shows an inclined insertion of an aerosol-generating article into a cavity of the aerosol-generating device.

FIG. 3 shows insertion of the aerosol-generating article 12 with an inclined insertion direction. Due to the flexible configuration of the resilient sealing element 38, the inclined insertion of the aerosol-generating article 12 is possible. The resilient sealing element 38 applies pressure to the aerosol-generating article 12 to urge the aerosol-generating article 12 into an orientation along the longitudinal axis of the cavity 10.

Figure 4:
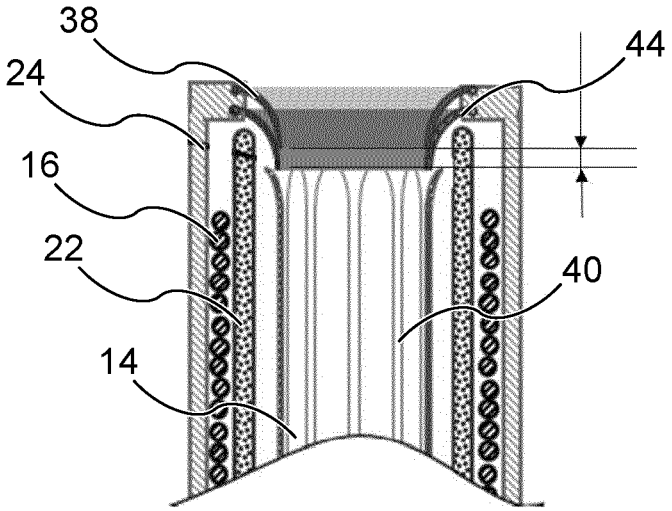
FIG. 4 shows an embodiment of a resilient sealing element comprising two ring-shaped resilient sealing elements.

FIG. 4 shows an embodiment of the resilient sealing element 38. In this embodiment, instead of a single resilient sealing element 38, two resilient sealing elements 38, 44 are provided. The two resilient sealing elements 38, 44 are arranged adjacent to each other along the longitudinal axis of the cavity 10. Each individual of the resilient sealing elements 38, 44 is configured as the single resilient sealing element 38 described herein. Particularly, each of the individual resilient sealing elements 38, 44 has a funnel shape to improve insertion of the aerosol-generating article 12. By providing two resilient sealing elements 38, 44, two contact points between the resilient sealing elements 38, 44 and the aerosol-generating article 12 are provided. These two contact points improve the holding action of the aerosol-generating article 12. Alternatively or additionally, the two contact points improve correction of the orientation of the aerosol-generating article 12 during and after insertion of the aerosol-generating article 12 into the cavity 10, if the aerosol-generating article 12 has an inclined orientation with respect to the central longitudinal axis of the cavity 10. Alternatively or additionally, two contact points improve the hermetic sealing action of the cavity 10 with respect to the outside of the aerosol-generating device so that air can only escape the cavity 10 through the aerosol-generating article 12.

Figure 5:
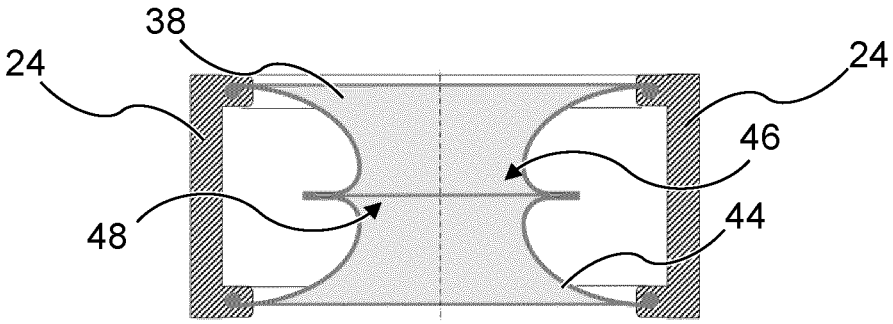
FIG. 5 shows a further embodiment of the two ring-shaped resilient sealing elements with an inverted orientation.

FIG. 5 shows a further embodiment of the resilient sealing element 38. Similar to the embodiment shown in FIG. 4, two resilient sealing elements 38, 44 are provided. In contrast to the similar arrangement of the two sealing elements 38, 44 in the embodiment shown in FIG. 4, the two resilient sealing elements 38, 44 are arranged in an inverted orientation in the embodiment depicted in FIG. 5. The inverted orientation of the two sealing elements 38, 44 improves the funnel shape of the two sealing elements 38, 44. The inverted orientation may alternatively or additionally improve stability of the two sealing elements 38, 44. The first resilient sealing element 38 is a downstream resilient sealing element. The second resilient sealing element 44 is an upstream resilient sealing element. The upstream end face 46 of the first resilient sealing element 38 contacts the downstream end face 48 of the upstream sealing element 44.

The invention claimed is:

1. Aerosol-generating device comprising:

a cavity for receiving an aerosol-generating article containing an aerosol-forming substrate; and a resilient sealing element having a ring shape, wherein the resilient sealing element is arranged to be surrounding a downstream end of the cavity, wherein the resilient sealing element is configured to abut the aerosol-generating article when the aerosol-generating article is received within the cavity, wherein the resilient sealing element comprises at least two resilient sealing elements, wherein the resilient sealing elements are flexible and ring-shaped, and wherein the at least two flexible ring-shaped resilient sealing elements are arranged axially parallel to a longitudinal axis of the aerosol-generating device and inverted, wherein inverted comprises one resilient sealing element is funnel-shaped with the end face with the smaller diameter being oriented upstream, while the other resilient sealing element is funnel-shaped with the end face with the larger diameter being oriented upstream.

2. Aerosol-generating device according to claim 1, wherein the resilient sealing element is configured to center the aerosol-generating article during insertion of the aerosol-generating article into the cavity.

3. Aerosol-generating device according to claim 1, wherein the resilient sealing element fully surrounds the downstream end of the cavity.

4. Aerosol-generating device according to claim 1, wherein the resilient sealing element is configured to enable insertion of the aerosol-generating article with an inclined insertion angle due to the flexible configuration of the resilient sealing element.

5. Aerosol-generating device according to claim 1, wherein the resilient sealing element is configured to enable insertion of aerosol-generating articles having different diameters due to the flexible configuration of the resilient sealing element.

6. Aerosol-generating device according to claim 1, wherein the resilient sealing element is made of an elastic, heat-resistant polymer or compound material.

7. Aerosol-generating device according to claim 1, wherein the resilient sealing element is configured to hermetically seal the cavity when the aerosol-generating article is received in the cavity while allowing airflow through the aerosol-generating article.

8. Aerosol-generating device according to claim 1, wherein the at least two flexible ring-shaped resilient sealing elements are arranged coaxial.

9. Aerosol-generating device according to claim 1, wherein an outer circumference of the resilient sealing element is attached to a housing of the aerosol-generating device.

10. Aerosol-generating device according to claim 1, wherein the at least two flexible ring-shaped resilient sealing elements are arranged coaxial and axially overlapping.

11. Aerosol-generating device according to claim 1, wherein the resilient sealing element is made of an elastic, heat-resistant polymer or compound material comprising graphene, silicone, or plastic.

* * * * *